US010603771B2

(12) United States Patent
Connery et al.

(10) Patent No.: US 10,603,771 B2
(45) Date of Patent: Mar. 31, 2020

(54) SPRINKLER INSTALLATION TOOLS AND METHODS

(71) Applicant: TYCO FIRE PRODUCTS LP, Lansdale, PA (US)

(72) Inventors: Luke Stevenson Connery, Rehoboth, MA (US); Jeffrey Martin Brighenti, Cranston, RI (US); Bharani Kannan, Chennai (IN); Manikandan Krishnaswamy, Bangalore (IN); Kenneth Robert Brown, Chesterfield, MO (US); Joseph W. Beagen, West Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 439 days.

(21) Appl. No.: 15/314,622

(22) PCT Filed: May 28, 2015

(86) PCT No.: PCT/US2015/032976
§ 371 (c)(1),
(2) Date: Nov. 29, 2016

(87) PCT Pub. No.: WO2015/184137
PCT Pub. Date: Dec. 3, 2015

(65) Prior Publication Data

US 2017/0129081 A1 May 11, 2017

Related U.S. Application Data

(60) Provisional application No. 62/005,777, filed on May 30, 2014, provisional application No. 62/068,442,
(Continued)

(51) Int. Cl.
*B25B 27/00* (2006.01)
*B25B 23/08* (2006.01)
(Continued)

(52) U.S. Cl.
CPC ..... *B25B 27/00* (2013.01); *B25B 23/08* (2013.01); *A62C 35/68* (2013.01); *E04B 9/006* (2013.01)

(58) Field of Classification Search
CPC ..... B25B 27/00; B25B 23/08; A62C 35/68; E04B 9/006
See application file for complete search history.

(56) References Cited

U.S. PATENT DOCUMENTS 3,675,952 A 7/1972 Mears
D456,226 S * 4/2002 Doshay ..... D8/17
(Continued)

FOREIGN PATENT DOCUMENTS

FR 2850894 8/2004

OTHER PUBLICATIONS

International Search Report and Written Opinion for International Application No. PCT/US2015/032976, dated Aug. 27, 2015, 8 pages.

(Continued)

*Primary Examiner* — Sarang Afzali
(74) *Attorney, Agent, or Firm* — Foley & Lardner LLP

(57) ABSTRACT

Installation tools and methods for installing a sprinkler within an opening or through hole in a wall or ceiling of an area to be protected. The tools include a reference surface and a gauge to be contacted by a sprinkler frame. The reference surface locates the gauge to define an operative position for the sprinkler frame and its operational components within a through hole of a wall.

19 Claims, 6 Drawing Sheets

Related U.S. Application Data filed on Oct. 24, 2014, provisional application No. 62/107,917, filed on Jan. 26, 2015.

(51) Int. Cl.
*E04B 9/00* (2006.01)
*A62C 35/68* (2006.01)

(56) References Cited

U.S. PATENT DOCUMENTS 7,240,884 B2 * 7/2007 Shim ..... E04B 9/006 24/292
7,328,891 B2 * 2/2008 Watanabe ..... B25B 1/103 269/147
7,513,492 B1 * 4/2009 Kuo ..... B25B 5/068 269/3
8,322,697 B2 * 12/2012 Lin ..... B25B 5/003 269/143
8,418,372 B1 * 4/2013 Risley, Sr. ..... B26B 29/06 269/6
8,833,718 B2 * 9/2014 Oh ..... A62C 35/68 239/283
8,850,931 B1 * 10/2014 Hebert ..... B25B 13/16 81/129
10,173,088 B2 * 1/2019 Chong ..... F16L 3/24
2004/0245692 A1 * 12/2004 Brass ..... B25B 5/003 269/3
2013/0174498 A1 7/2013 Hovren

OTHER PUBLICATIONS

Tyco Fire Protection Products, "Raven Studio Sprinklers: 5.6K Institutional Sprinklers Pendent and Horizontal Sidewall Quick Response, Standard and Extended Coverage", Oct. 16, 2014, 12 pages.
Tyco Fire Protection Products, "Raven 5.6K Institutional Sprinklers Pendent and Horizontal Sidewall Quick Response, Standard and Extended Coverage", Aug. 2013, 10 pages.

* cited by examiner

SPRINKLER INSTALLATION TOOLS AND METHODS

PRIORITY DATA & INCORPORATION BY REFERENCE

This application is a 35 U.S.C. § 371 application of International Application No. PCT/US2015/032976 filed May 28, 2015, which claims the benefit of priority to U.S. Provisional Application No. 62/005,777, filed May 30, 2014; U.S. Provisional Application No. 62/068,442, filed Oct. 24, 2014; and U.S. Provisional Application No. 62/107,917, filed Jan. 26, 2015, each of which is incorporated by reference in its entirety.

TECHNICAL FIELD

The present invention relates generally to fire protection devices and more specifically to devices for the installation of fire protection sprinklers within a through hole of a finished or unfinished ceiling or wall. As used herein, "wall" can be either a vertical wall or an overhead wall, such as a ceiling. The wall can be of any material that provides for a cover or cladding that presents a face or surface of the cladding.

BACKGROUND ART

Fire protection devices or sprinklers, which discharge a firefighting fluid such as water, gas or other chemical agent, can be designed to protect a variety of occupancies, both commercial and residential. For many of these applications the sprinkler is installed within a cored through hole or other opening in a wall or ceiling of an area to be protected by the sprinkler. Generally, the sprinkler includes a body having an inlet end connected to a fluid supply or branch line behind the wall or above the ceiling and an outlet end positioned to provide protection to the protection area. The sprinkler includes a thermally responsive trigger and fluid distribution components for distributing a firefighting fluid upon thermal actuation of the sprinkler. For some concealed type sprinklers, the trigger is supported by the sprinkler body and the fluid distribution components are embodied by an internal fluid deflector assembly. The sprinkler is positioned within the cored through hole such that, upon actuation, the fluid distribution components of the sprinkler, such as for example the internal fluid deflector assembly, are in their operative position to properly address a fire or other heat generating event in accordance with the designed performance of the sprinkler. As used herein, "operative position" describes the installed relative position of a component to another component or structure that is desired, designed, or required in order for the component(s) to operate as intended when in service.

TYCO FIRE PRODUCTS LP Technical Data Sheet TFP651 entitled "RAVEN 5.6K Institutional Sprinklers Pendent and Horizontal Sidewall Quick Response, Standard and Extended Coverage" (August 2013), which is incorporated by reference in its entirety, describes installation of a concealed sprinkler in a cored through hole of a wall. The sprinkler body includes an external tapered thread, e.g., National (American) Pipe Thread Tapered (NPT) at its inlet end for coupling to a pipe fitting, such as for example a reducer fitting of the fluid supply piping, having a corresponding internal tapered thread. The proper location of the pipe fitting relative to the mounting surface of the wall and its tapered threaded engagement with the sprinkler body properly locates a thermally responsive trigger and internal deflector assembly in their operative positions relative to the mounting surface of the wall surrounding the cored through hole formed in the wall. The installation can include a captive escutcheon disposed about the sprinkler frame for mounting flush to the mounting surface of the wall. The escutcheon can also act to properly locate the components in their operative position by controlling the depth of the sprinkler frame within the through hole. Additional details of the tapered thread installation are described in Technical Data Sheet TFP651.

There is a need for an installation device and method for installing and locating a sprinkler in its operative position in either unfinished or finished wall systems in the absence of a tapered thread and corresponding tapered thread engagement. For example, a sprinkler body employing a coupling mechanism other than a tapered thread, such as a straight or parallel thread, e.g., British Standard Pipe Parallel thread (BSPP), quick-connect coupling, or adjustable fitting, can present such a need for devices or methods to properly locate the sprinkler, thermally responsive trigger and internal deflector in their operative positions relative to, for example, the mounting surface of the surrounding wall. An exemplary sprinkler using an adjustable fitting is shown in U.S. Pat. No. 3,675,952 to Mears, which is directed to an adjustable drop nipple for a pendent sprinkler. Moreover, there is a need for an installation device and method for installing and locating a sprinkler to allow a captive escutcheon to be flush mounted to the wall mounting face about the sprinkler. If the sprinkler is not coupled to the fluid supply piping at a sufficient depth within the through hole of the wall, the escutcheon might be loosely disposed about the sprinkler.

DISCLOSURE OF INVENTION

Preferred installation tools and methods of their use in installing a sprinkler having a sprinkler frame supporting and housing at least one operational component are provided. A preferred installation tool includes a gauge defining a stop surface for contacting and locating a sprinkler frame. The tool also includes a reference surface that locates the stop surface to define an operational position for the sprinkler frame and the at least one operational component within a through hole or opening of a wall. One embodiment provides a preferred installation tool for installing a sprinkler in an unfinished wall installation. The tool preferably includes a rail member that defines the reference surface and further includes the gauge defining the stop surface for contacting and locating a sprinkler body. The preferred tool has a guide member in a sliding engagement with the rail member and defines another reference surface. The gauge is preferably engaged with the guide member to locate the stop surface relative to the reference surface of the guide member. Another preferred embodiment of an installation tool is provided for installing a sprinkler within a through hole in a wall of an area to be protected. The preferred tool preferably includes a wall contact portion having a planar reference surface for abutting a mounting surface about the through hole and an insertion gauge for inserting in the through hole to define a stop surface within the through hole for contacting and locating a sprinkler body and its operational components within the through hole relative to the mounting surface in a preferably operative position.

Preferred methods of sprinkler installation are provided for finished and unfinished wall systems. A preferred method of installing the sprinkler in its operative position includes forming a connection of an adjustable length between the sprinkler and a fluid supply pipe; defining an operative position for the sprinkler relative to a face of a wall about the sprinkler with an installation tool; and contacting the sprinkler to the installation tool. A preferred method of installing a sprinkler in an unfinished wall preferably includes locating a reference surface of the installation tool to locate a stop surface of a gauge of the installation tool proximate the connection; and adjusting the length of the connection to bring the sprinkler into contact with the stop surface. The reference surface is preferably located against a stud member of an unfinished wall. The preferred installation tool includes a rail member defining the reference surface and a guide member having a sliding engagement with the rail member. The gauge is preferably engaged with the guide member. The preferred method can include locating a second reference surface by a spacing between the gauge and the guide member. The spacing preferably indicates a thickness of a wall to be mounted to the stud member to define a finished wall, and locating the second surface locates the stop surface relative to a mounting face of the wall. In one preferred aspect, the method of installation includes axially aligning an indicator with the sprinkler, contacting the wall to the indicator to define a centering mark, forming a through hole in the wall centered about the centering mark and disposing the wall over the sprinkler and mounting the wall to the stud member to locate the sprinkler within the through hole such that operational components of the sprinkler are located in their operative position relative to the mounting face of the wall. In one preferred method, axially aligning the indicator includes disposing a protective cap over the sprinkler in which the cap includes a handle centrally aligned with the sprinkler with the handle including the indicator.

A preferred adjustable connection between the sprinkler and the fluid supply pipe connection includes an adapter having an external tapered thread coupled to the fluid supply pipe and an internal straight thread coupled to the sprinkler. Accordingly, preferred methods of installing a sprinkler include coupling a pipe fitting adapter to a fluid supply pipe, in which the pipe fitting adapter has an external tapered thread and an internal straight thread. Preferred sprinklers for installation have a sprinkler body with a proximal portion and a distal portion supporting a thermally responsive trigger and housing an internal deflector. The proximal portion includes a straight external thread for engaging the internal thread of the pipe fitting adapter.

Additional preferred methods of installing a sprinkler include locating a reference surface of an installation tool to locate a stop surface of a gauge of the installation tool proximate the pipe fitting adapter; and threading a sprinkler body into the pipe fitting adapter to bring the sprinkler into contact with the stop surface. One preferred method of installing a sprinkler within a through hole in a wall having a mounting surface about the through hole preferably includes coupling a pipe fitting adapter to a fluid supply pipe within the through hole and locating an installation tool against the mounting surface with a gauge portion of the tool inside the through hole to define a stop surface relative to the mounting surface; and threading a sprinkler body into the pipe fitting adapter within the through hole. The method further preferably includes contacting the stop surface with a portion of the sprinkler body to locate at least one of the thermally responsive trigger or deflector in an operative position relative to the mounting surface and removing the gauge portion from the through hole.

Although the Disclosure of Invention and the described preferred installation tools and methods address the installation of a fire protection sprinkler in its operative position within a through hole of a finished or unfinished ceiling or wall, it should be understood that preferred features of the tools described herein can be combined and/or modified to install any fire protection device in an operative position relative to a fixture or other relative surface. The Disclosure of Invention is provided as a general introduction to some embodiments of the invention, and is not intended to be limiting to any particular configuration or method. It is to be understood that various features and configurations of features described in the Disclosure of Invention can be combined in any suitable way to form any number of embodiments of the invention. Some additional example embodiments including variations and alternative configurations are provided herein.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the preferred embodiments of the invention. It should be understood that the preferred embodiments are some examples of the invention as provided by the appended claims.

MODE(S) FOR CARRYING OUT THE INVENTION

Figure 1:
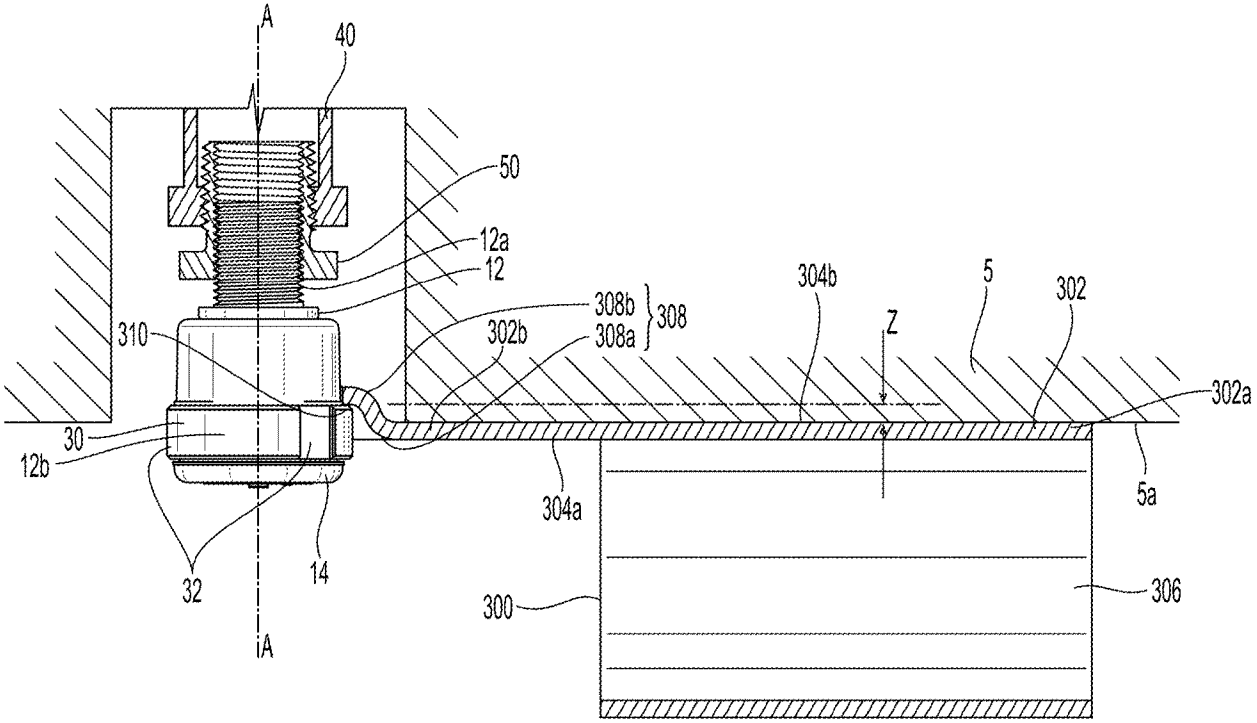
FIG. 1 is an illustrative embodiment of a preferred sprinkler installation in a finished wall using a preferred embodiment of a sprinkler installation tool.

A preferred embodiment of a sprinkler having a body 12 is shown in FIG. 1 with a first proximal end portion 12*a* for coupling to a fluid supply pipe fitting and a second distal end portion 12*b* for housing and supporting operational components of the sprinkler including a thermally responsive trigger 14 and internal fluid deflector assembly. The distal end portion 12*b*, trigger 14 and internal fluid deflector assembly can be configured similar to those of the concealed sprinkler shown in TFP651. The external thread on the proximal end 12*a* is preferably an external straight thread and more preferably ISO G⅜ in. DIN228 straight thread. Alternative straight thread includes, for example, National (American) Pipe Straight (NPS) or a machine thread or, further in the alternative, a fine thread, e.g., national fine (NF). The external straight thread provides for installation flexibility because formation of a fluid tight seal with the fluid supply pipe is independent of the threaded engagement of the proximal end 12*a*. Thus, the straight thread engagement can permit for adjustment or latitude in locating the sprinkler and body 12 in its operative position. However, due to the straight threads of the sprinkler body 12, the threaded engagement of the straight thread alone to a standard pipe fitting 40 cannot be relied upon to properly locate the sprinkler, its internal fluid distribution components and thermally responsive trigger in their operative positions relative to the mounting surface 5*a*. Accordingly, a preferred pipe adapter 50 is provided for coupling the straight threaded sprinkler body 12 to a fluid supply pipe fitting 40.

The preferred adapter 50 preferably includes an internal straight thread for coupling to the external straight thread of the sprinkler body 12. The adapter 50 also preferably includes an external tapered pipe thread for coupling to, for example, the pipe fitting 40 having an internal tapered thread. In one preferred embodiment, the adapter 50 provides for a straight thread-to-tapered thread (NPT) Adapter with ISO G⅜ in. DIN228 internal thread of a preferred one inch thread length and an external ½ in. NPT tapered thread of a preferred 0.64 inch thread length. The external thread of the sprinkler body 12 at the proximal end 12*a* defines a preferred axial thread length of ¾ inch, which provides a preferred minimum adjustment of ¾ inch to locate the sprinkler body 12 in a preferred operative position and/or orientation in a manner described herein. The adjustability minimizes or eliminates the need to accurately locate the pipe fitting 40; and more preferably provides a range of ¾ inch to 1 inch of flexibility in axially locating the sprinkler body 12 and/or the pipe fitting 40 relative to the mounting surface. To add additional installation flexibility, the total length of the body of the adapter 50 can preferably vary from 1 inch to 2 inches and more preferably have axial lengths of any one of 1 inch, 1½ inch or 2 inch. The flexibility of the preferred adapter 50 makes it easier to couple the sprinkler to the fluid supply pipe; however such flexibility can necessitate installation tools and/or methods to locate the sprinkler and its operational components in their operative positions relative to the face or mounting surface of the wall surrounding the sprinkler. Accordingly, preferred installation tools and methods are needed to locate the sprinkler in its operative position when the coupling to the fluid supply pipe does not.

Preferred embodiments of an installation tool and its use are described herein for installing a sprinkler body in either a finished wall or cladding or an unfinished wall. An exemplary finished wall can be a dry wall sheet mounted to a frame of two or more wall stud members. An unfinished wall is the stud member frame. The preferred tools for finished wall installations locate the sprinkler body within an opening or through hole formed in the finished wall such that the operational components of the sprinkler are properly located relative to a face or mounting surface of the wall. The preferred tools for unfinished wall installations locate the sprinkler body such that a cladding or wall can be disposed over the installed sprinkler through an opening or hole formed in the wall such that the operational components of the sprinkler are properly located relative to the face or mounting surface of the wall. The preferred installation tools preferably include a gauge portion defining a stop surface to be contacted by a sprinkler frame for locating the sprinkler frame at a depth relative to the wall face or mounting surface. To locate the stop surface, the installation tool includes a reference surface that contacts a wall structure, such as for example, the frame, stud members, or the cladding or wall itself to locate the stop surface relative to a face or surface of a finished wall finish or a to-be-finished wall.

Figure 2:
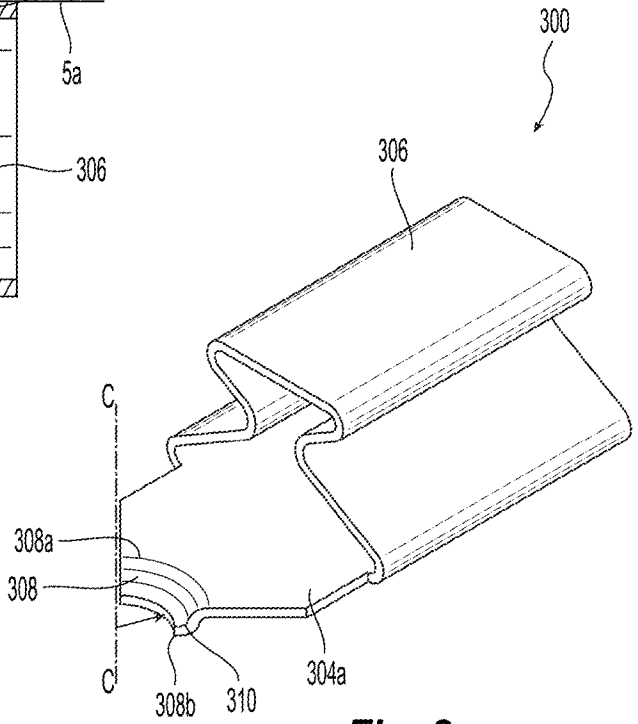
FIG. 2 is a perspective view of the installation tool used in FIG. 1.

A preferred installation tool 300, shown in FIGS. 1 and 2, is provided to properly locate the sprinkler body 12 and its operational components within the cored through hole of the wall 5 in their operative positions relative to the mounting surface 5*a*. The tool 300 preferably includes an elongate member 302 having a first end portion 302*a* and a second end portion 302*b*. The elongate member 302 includes a first surface 304*a* from which preferably extends a handle member 306 at the first end portion of the elongate member 302. The elongate member 302 includes a second surface 304*b* opposite the first surface 304*a* that is preferably planar for abutting the mounting surface 5*a*. Accordingly, the second surface 304*b* acts as a reference surface of the installation tool. Extending from the second surface 304*b* and formed at the second end portion 302*b* of the elongate member 302 is an insertion gauge portion 308. The gauge portion 308 preferably includes a first end 308*a* continuous with the elongate member 302 and a second end 308*b* located in a plane parallel to and spaced from the second surface 304*b* at a distance that can be used to properly locate the sprinkler body 12 relative to the mounting surface 5*a*.

The second end 308*b* of the gauge portion 308 defines a stop surface 310 preferably spaced at a distance Z from the planar second surface 304*b*. With the planar second surface 304*b* of the tool 300 abutting the mounting surface 5*a* and the second end 308*b* of the tool 300 disposed in the cored hole of the wall 5, the stop surface 310 is located at depth Z within the cored through hole for locating the sprinkler body 12, its internal deflector and the thermally responsive trigger 14 at their operative positions relative to the mounting surface 5*a*, for example as specified in TFP651. Accordingly, the tool can be appropriately configured to locate the stop surface at any appropriate depth within the through hole to place a sprinkler and its components in their appropriate operative positions.

The stop surface 310 is preferably arcuate, defining a central axis of curvature C-C that preferably extends perpendicular to the second surface 304*b*. The curvature of the stop surface 310 provides for a contour stop surface to contact a portion of the sprinkler body 12, such as for example, an edge of the preferred annular wall 30. The width of the elongate member 302 and the preferred taper of the gauge portion 308 from its first end 308*a* to its second end 308*b* facilitate removal of the tool 300 from the through hole after proper location of the sprinkler body 12 within the through hole. Alternative geometries of the stop surface 310 and gauge portion 308 can be provided to locate the sprinkler and its components in their appropriate operative positions.

Figure 2B:
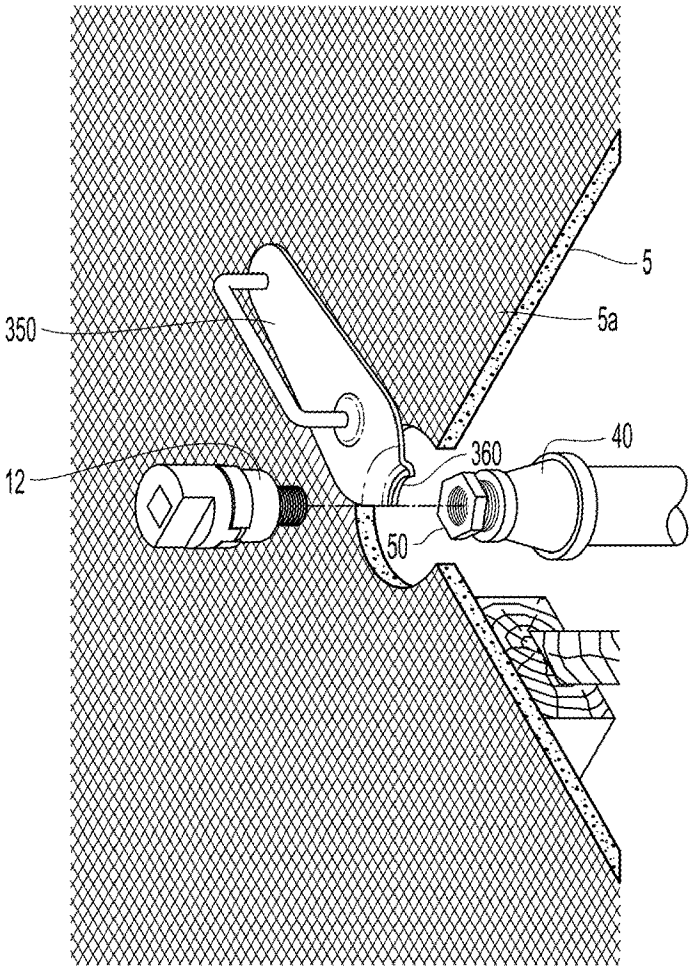
FIG. 2B is an illustrative perspective view of a sprinkler installation in a finished ceiling using the installation tool of FIG. 2A.
Figure 2A:
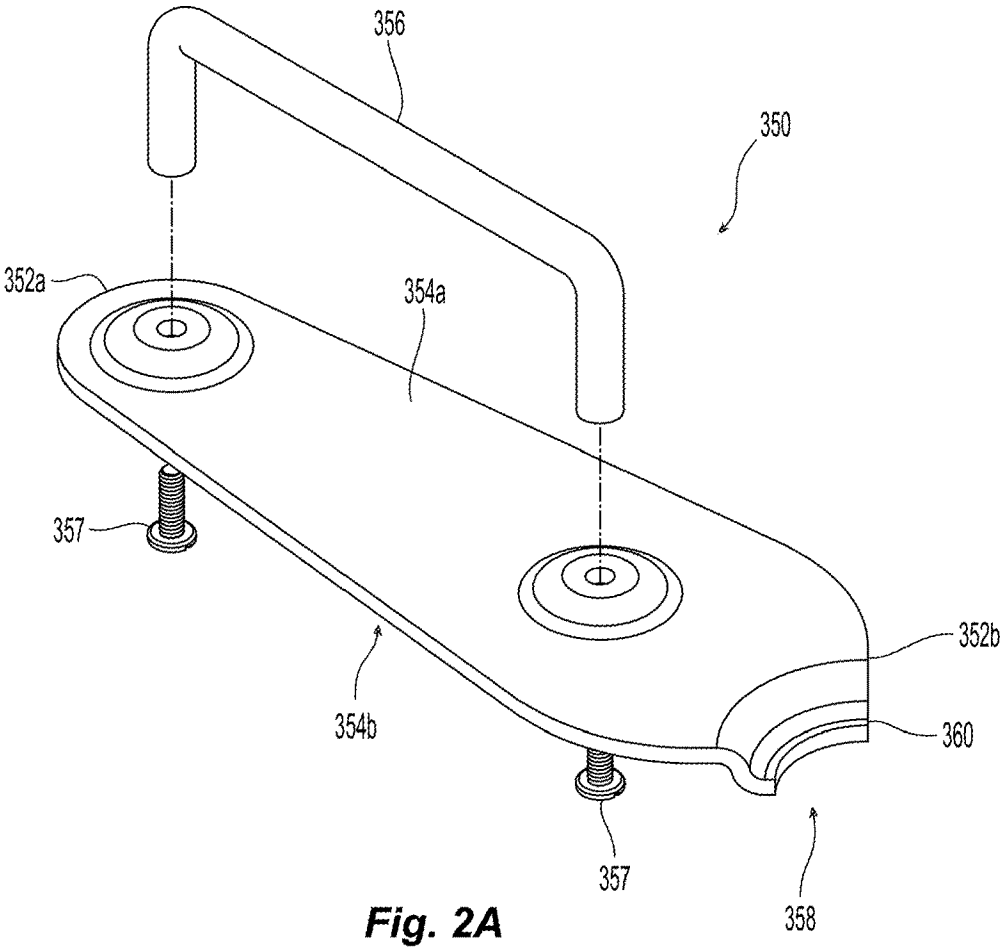
FIG. 2A is an exploded perspective view of another preferred embodiment of a sprinkler installation tool.

Another preferred installation tool 350 is shown in FIGS. 2A and 2B. The tool 350 preferably includes an elongate member 352 having a first end portion 352*a* and a second end portion 352*b*. The elongate member 352 includes a first surface 354*a* to which a separate handle member 356 is mounted or fastened. The elongate member 302 includes a second surface 354*b* opposite the first surface 354*a* that is a preferably planar reference surface for abutting the mounting surface 5*a*. The tool 350 can include one or more screws or other type of fasteners for fastening the handle 356 to the elongate member 352 and its first surface 354*a*. Extending from the second surface 304*b* and formed at the second end portion 352*b* of the elongate member 352 is an insertion gauge portion 358. The gauge portion 358 preferably includes a first end 308*a* continuous with the elongate member 302 and a second end 308*b* located in a plane parallel to and spaced from the second surface 304*b* at a distance that can be used to properly locate the sprinkler body 12 relative to the mounting surface 5*a*.

The second end 358*b* of the gauge portion 358 defines a stop surface 360 preferably spaced at a distance from the planar second surface 354*b*. With the planar second surface 354*b* of the tool 350 abutting the mounting surface 5*a* and the second end 358*b* of the gauge portion 358 disposed in the cored hole of the wall 5, as seen in FIG. 2B, the stop surface 360 is located at depth within the cored through hole for locating the sprinkler body 12, its internal deflector and the thermally responsive trigger 14 at their operative positions relative to the mounting surface 5*a*. Accordingly, the tool 350 can locate the stop surface 360 at a depth within the through hole to place a sprinkler and its components in their appropriate operative positions in a manner as previously described.

The stop surface 360 is preferably arcuate to provide for a contour stop surface to contact a portion of the sprinkler body 12, such as for example, an edge of the preferred annular wall 30. The width of the elongate member 352 preferably tapers narrowly from the second end portion 352*b* to the first end portion 352*a*. The handle 356 is preferably circular in cross-section and dimensioned to provide a comfortable gripping member or surface for the hand of the installer. The handle 356 can have a simple C-shape or may have and alternate geometry provided the geometry permits the installer to grip the tool and install a sprinkler in a manner as described herein.

Figure 3:
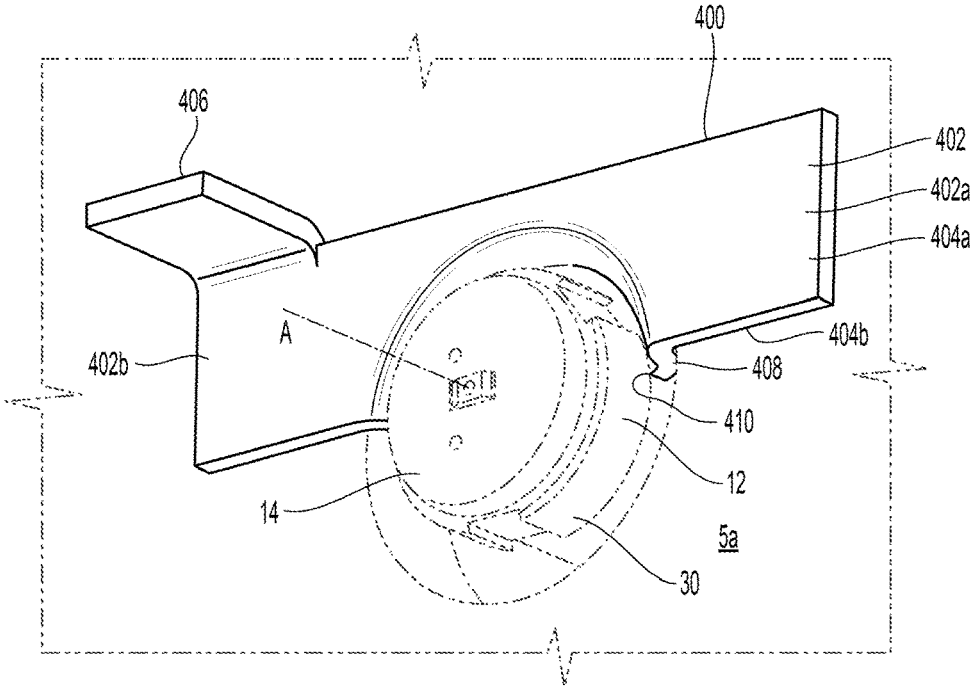
FIG. 3 is another illustrative embodiment of a preferred installation tool for installing a preferred embodiment of the sprinkler body in FIG. 1 in a finished wall.
Figure 4:
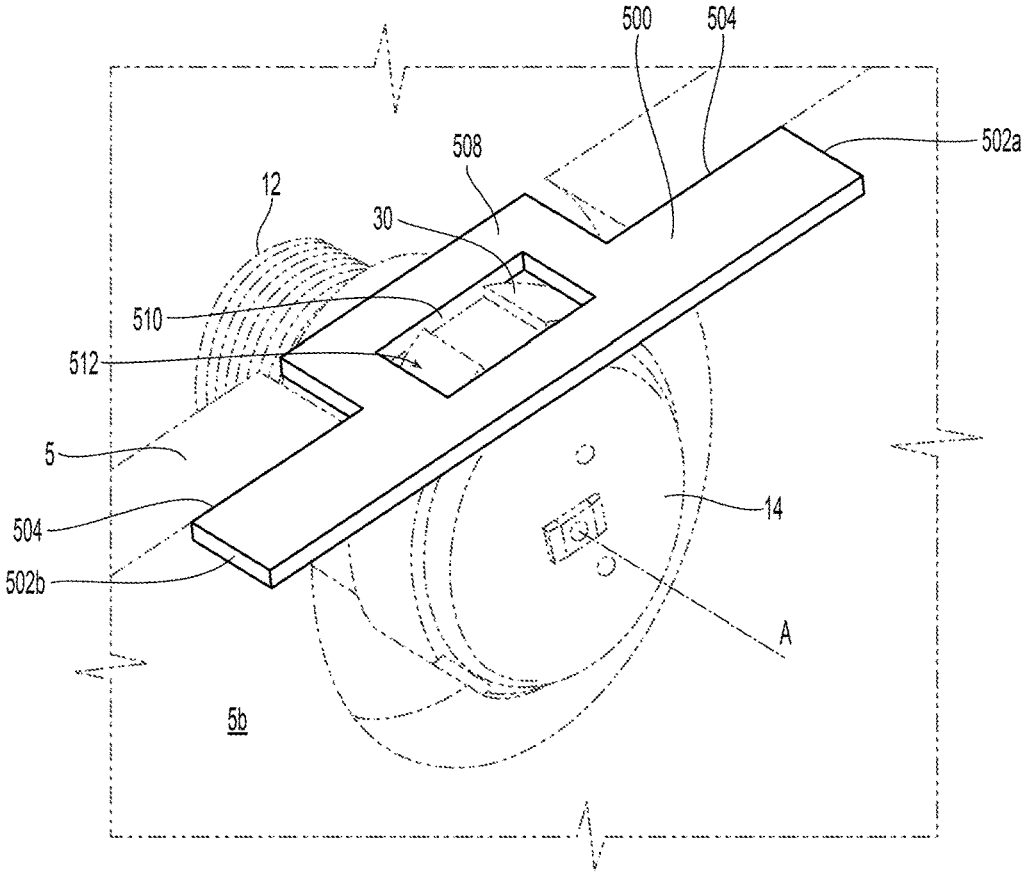
FIG. 4 is yet another illustrative embodiment of a preferred installation tool for installing a preferred embodiment of the sprinkler body in FIG. 1 in a finished wall.

Additional alternate embodiments of the installation tool are shown in FIGS. 3 and 4. The installation tool 400 in FIG. 3 preferably includes an elongate member 402 having a first end 402*a* and an opposite second end 402*b*. A first surface 404*a* of the tool preferably includes a handle portion formed or disposed at one of the first end and the second end 402*a*, 402*b*. An opposite second surface 404*b* preferably includes a planar surface as a preferred reference surface for abutting the mounting surface 5*a* of the wall 5. Preferably formed between the first and second ends 402*a*, 402*b* is the insertion gauge portion 408. The insertion gauge portion 408 preferably defines the stop surface 410 for contacting and locating the sprinkler body 12. For example, the stop surface 410 contacts the preferred annular wall of the sprinkler body 12 to locate the trigger 14 and/or the internal deflector in its operative position relative to the mounting surface 5*a*. The gauge portion 408 when inserted in the through hole of the wall 5 preferably approximates or traverses an arc length of the through hole to use the wall surfaces of the through hole to properly locate the stop surface within the through hole. Accordingly, the gauge portion 408 and its stop surface 410 preferably define a central axis of curvature extending perpendicular to the planar surface 404*b* for alignment with or parallel to the through hole center when installed. The preferred partial arc or curvature of the gauge portion 408 and its stop surface 410 permits manipulation within and removal from the through hole upon locating the sprinkler body.

Another alternate embodiment of the installation tool 500 is shown in FIG. 4. The tool 500 includes a planar member 502 having a first end portion 502*a* and an opposite second end portion 502*b*. Each of the first and the second end portions 502*a*, 502*b* includes an edge to preferably define a planar reference surface 504 for abutting the mounting surface 5*b*. Preferably formed between the first and second end portions 502*a*, 502*b* is the insertion gauge portion 508. The insertion gauge portion 508 preferably includes an edge internal to the planar member to define the stop surface 510. The internal edge preferably extends parallel to the planar surface and more preferably includes a plurality of interconnected edges internal to the planar member to define a closed form void 512 in the planar member, which can be for example, rectangular as shown.

The preferred installation tool provides for methods of installing a sprinkler assembly within a through hole in a finished wall of an area to be protected. The method preferably includes locating the installation tool against the mounting surface with a gauge portion of the tool inside the through hole to define the stop surface relative to the mounting surface and contacting the stop surface with a portion of the sprinkler body to locate the internal deflector of the sprinkler body and/or the thermally responsive trigger in an operative position relative to the mounting surface. The straight thread-to-NPT Adapter can be threaded onto the sprinkler body with an appropriate applied sealant to couple the sprinkler body to the fluid supply line. The sprinkler body 12 can be threaded and appropriately oriented into its operative position by hand or more preferably using an installation tool (not shown) engaged with peripheral slots 32 of the sprinkler body.

Although the installation tools herein are shown and described in the installation of a sprinkler body having a straight thread, it should be understood that the tools can be used to locate any sprinkler in its operative position that does not rely on fixed length piping to locate the sprinkler. Accordingly, the tools described herein could be used to locate any sprinkler in its operative position in which the sprinkler is coupled to a fluid supply pipe by a coupling or fitting where the length of the connection between the sprinkler and the fluid supply pipe is adjustable. Preferred methods of installing a sprinkler described herein include forming a connection of an adjustable length between the sprinkler and a fluid supply pipe; locating an installation tool proximate the connection to define an operative position for the sprinkler relative to a face or mounting surface of a wall about the sprinkler; and adjusting the length of the connection to contact the sprinkler to the installation tool to place the sprinkler in its operative position. More preferably, locating the installation tool includes locating a reference surface of the installation tool against a wall surface to locate a stop surface of a gauge of the tool proximate the connection; and the adjusting of the length of the connection to bring the sprinkler into contact with the stop surface so as to place the sprinkler and its operational components into their operative positions.

Figure 5A:
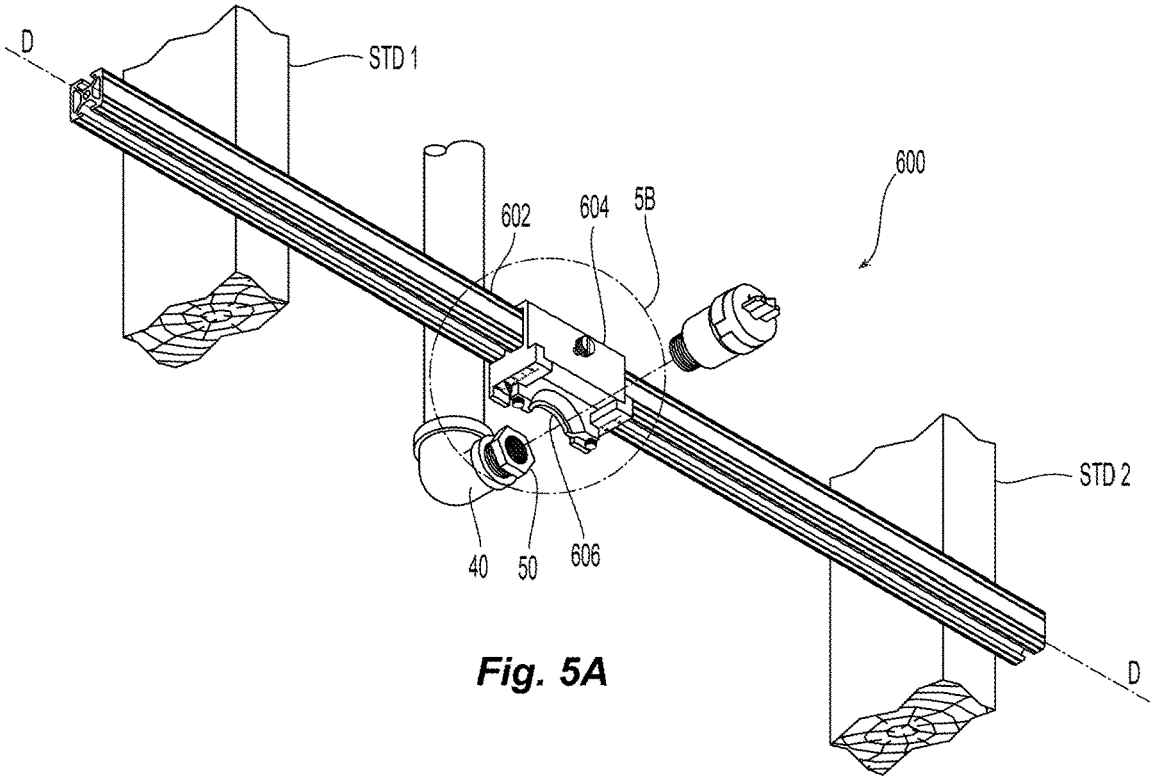
FIG. 5A is a preferred embodiment of an installation tool for installing a sprinkler in an unfinished wall.
Figure 5B:
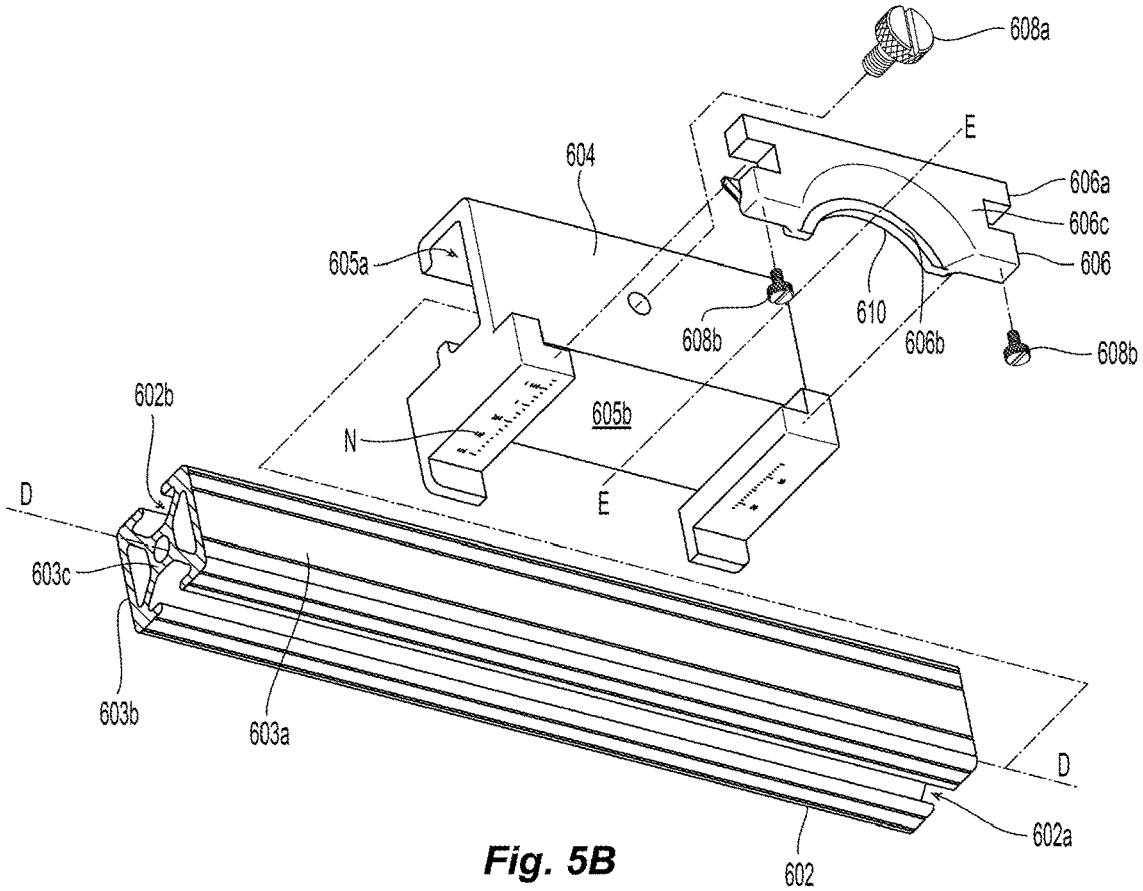
FIG. 5B is a detailed perspective exploded view of the installation tool of FIG. 5A.

The installation tools of FIGS. 2-4 are used on a dry wall surface and more preferably on a finished dry wall surface. Shown in FIGS. 5A-5B is another installation tool 600 for installing a sprinkler along an unfinished wall or ceiling which is framed by, for example, structural or stud members as illustrated, two preferably parallel stud members STD1, STD2. The members can be constructed of wood, metal or a composite material. The stud members STD1, STD2 can include a 2×4 inch wood plank member alone or can additionally or alternatively include a channel member or other structural member on top of the member STD1, STD2. The installation tool 600 includes a preferably elongated rail member 602 defining a preferred first reference surface, a guide member 604 for riding along the length of the rail member 602 and defining a second reference surface, and a gauge member 606 for engaging the guide member 604 to define a stop surface for locating a sprinkler for preferably coupling to a pipe fitting and adapter 40, 50 and for more preferably locating the internal components in their operative position relative to the face or mounting surface of a cladding or wall finish to be mounted to the unfinished stud members STD1, STD 2.

The rail member 602 is preferably structural tubing defining a pair of lateral guide rails 602*a*, 602*b* extending along the length of the rail member 602 and its axis of elongation D-D. As shown in FIG. 5B, a preferred rail member 602 preferably includes two web members 603*a*, 603*b* disposed about a central web member 603*c*. The web members 603*a*, 603*b* are spaced apart by the central web member 603*c* to define the lateral guide rails 602*a*, 602*b*. The rail member 602 defines an axial length for extending at least from stud-to-stud STD1, STD2.

The guide member 604 preferably engages the lateral guide rails 602*a*, 602*b* for sliding engagement with the rail member 602 in the direction of elongation D-D. As shown in FIG. 5B, the guide member 604 defines a first channel and more preferably a first c-channel 605*a* for wrapping about one of the web members 603*a*, 603*b* for preferred engagement with the lateral guide rails 602*a*, 602*b*. With the guide member 604 in a sliding engagement with the rail member 602, the guide member 604 can slide to a desired location along the rail member 602. Accordingly, the rail member defines a first reference surface. Once located, the guide member 604 can be locked into its desired location by a fastener 608*a*, such as for example a locking or set screw 608*a*.

The guide member 604 preferably defines a second channel and more preferably a second c-channel 605*b* for translation of the gauge member 606 in a direction orthogonal to the rail member 603, preferably orthogonal to the unfinished wall and more particularly orthogonal to the wall surface to be mounted to the studs STD1, STD2. The second channel 605*b* preferably defines an axis of translation E-E that is orthogonal to the axis of elongation D-D of the rail member 602. The gauge member 606 is located along the second channel 605*b* based on the wall thickness of the wall to be disposed about the sprinkler in order to define the depth at which the sprinkler body is to be located in the opening or through hole of the wall so as to locate the sprinkler components in their proper operative positions. Accordingly, the guide member 604 defines a second reference surface with the second channel 605*b* being preferably graduated to identify the wall thickness of the wall to be disposed about the sprinkler and the optional locations of the guide member along the second channel 605*b*. For example, the guide member can be graduated in inches N of wall thickness. To affix or lock the location of the gauge member 606 along the channel 605*b*, one or more fasteners 608*b*, such as for example set or lock screws, can be used to lock the guide member in the desired location along the channel 605*b*.

The gauge member 606 preferably includes a first gauge portion 606*a* for a preferred sliding engagement within the second channel 605*b*, and an opposite second gauge portion 606*b* to define a sprinkler contact surface and more preferably define a stop surface 610 as previously described. The first gauge portion preferably defines a geometry that allows the gauge member 606 to slide within the second channel 605*b* in the direction of the axis E-E but otherwise limit its movement axially within the channel 605*b*. In one particular embodiment, the first gauge portion 606*a* is substantially rectangular and at least partially surrounded along each of its edges such that movement of the gauge member 606 is limited to the axial direction of the channel 605*b*.

Preferably separating the first gauge portion 606*a* from the second gauge portion 606*b* is a narrowed neck portion 606*c*. The second gauge portion 606*b* is preferably configured with a stop surface as previously described for contacting and locating a sprinkler frame. Accordingly, a preferred stop surface 610 is preferably arcuate, defining a central axis of curvature that preferably extends parallel to the channel axis E-E. The curvature of the stop surface 610 provides for a contour stop surface to contact a portion of the sprinkler body 12, such as for example, an edge of the preferred annular wall 30. Alternative geometries of the stop surface 610 can be provided to locate the sprinkler and its components in their appropriate operative positions. With the gauge member 606 properly located in the second channel 605*b* of the guide member 604, the stop surface 610 locates a sprinkler to be coupled to an adjacent pipe fitting 40 and preferred adapter 50. Moreover, the stop surface 610 locates the components of the sprinkler in their operative position when a cladding, such as for example a dry wall sheet, is disposed over the sprinkler.

In a preferred method of installing a sprinkler in an unfinished wall, the gauge member 606 is adjusted to a referenced height within the second channel 605*b* of the guide member 604 to the thickness of the dry wall other material that will be used on the wall/ceiling about the sprinkler. With a sprinkler engaged with an adapter 50 and pipe fitting 40, the rail member 602 is placed in contact and more preferably abutting at least two stud members STD1, STD2 and the guide member 604 is laterally located or referenced between the stud members STD1, STD2 and adjacent to the sprinkler, pipe fitting 40, and adapter 50. In one preferred aspect of the installation, the pipe fitting 40 and its inlet face are preferably located relative to the surfaces of the stud members STD1, STD2 that are contacted by the rail member 602 by accounting for the thickness of the dry wall or other material that will be used on the wall/ceiling about the sprinkler in order to facilitate the location of the sprinkler using the installation tool 600 as described herein. The sprinkler is then turned until the sprinkler frame is threaded and/or properly oriented into contact with the stop surface 610 as previously described.

Figure 5C:
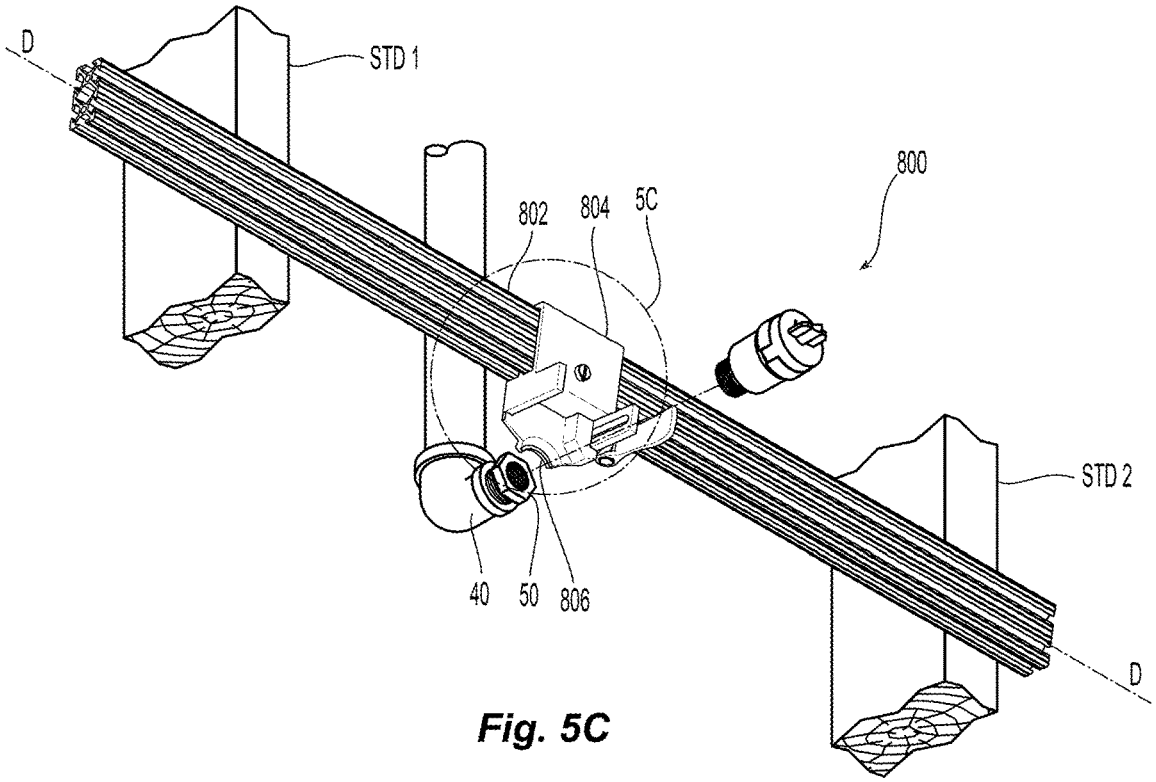
FIG. 5C is a preferred embodiment of another installation tool for installing a sprinkler in an unfinished wall.
Figure 5D:
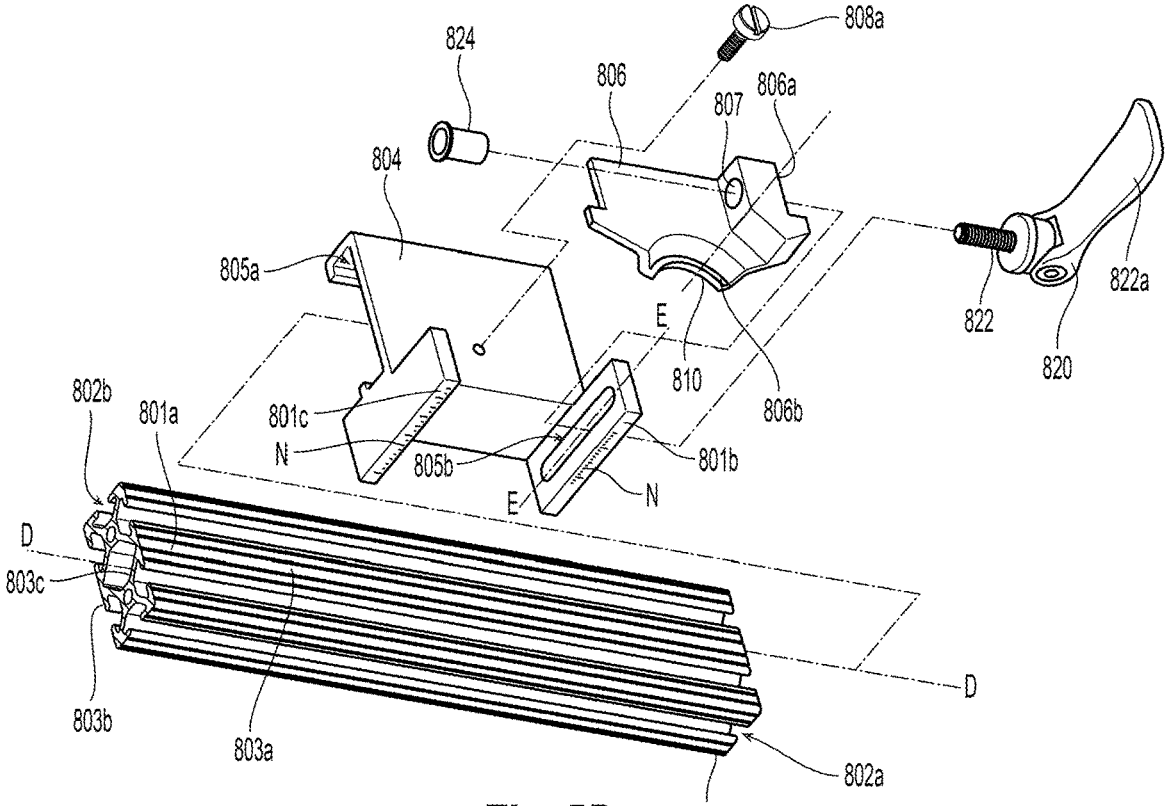
FIG. 5D is a detailed perspective exploded view of the installation tool of FIG. 5C.

Shown in FIGS. 5C-5D is an alternate embodiment of an installation tool 800 for installing a sprinkler along an unfinished wall or ceiling which is framed by, for example, structural or stud members as illustrated, two preferably parallel stud members STD1, STD2. The installation tool 800 includes a preferably elongated rail member 802 defining a preferred first reference surface, a guide member 804 for riding along the length of the rail member 802 and defining a second reference surface, and a gauge member 806 for engaging the guide member 804 to define a stop surface for locating a sprinkler for preferably coupling to a pipe fitting and adapter 40, 50 and for more preferably locating the internal components in their operative position relative to the face or mounting surface of a cladding or wall finish to be mounted to the unfinished stud members STD1, STD 2.

The rail member 802 is preferably structural tubing defining lateral guide rails 802*a*, 802*b* extending along the length of the rail member 802 and its axis of elongation D-D. As shown in FIG. 5D, a preferred rail member 802 preferably includes two or more web members or portions 803*a*, 803*b* disposed about a central web region 803*c* defined by one or more portions. The web members 803*a*, 803*b* are spaced apart by the central web region 803*c* to define the lateral guide rails 802*a*, 802*b*. The rail member 802 defines an axial length for extending at least from stud-to-stud STD1, STD2. Exemplary structural tubing for use as rail members 602, 802 include extrusions for aluminum T-Slotted Framing available from McMaster-Carr®, such as for example, two inch (2 in.) Six-Slot Double extrusion for extrusions for aluminum T-Slotted Framing, or Two-Slot Single Inline extrusions for aluminum T-Slotted Framing available at <http://www.mcmaster.com/#catalog/121/1924/=vmgo9r>.

The guide member 804 preferably engages the lateral guide rails 802*a*, 802*b* for sliding engagement with the rail member 802 in the direction of elongation D-D. As shown in FIG. 5D, the guide member 804 defines a guide channel preferably configured as a c-channel 805*a* for wrapping about one or more of the web members 803*a*, 803*b* for preferred engagement with the lateral guide rails 802*a*, 802*b*. With the guide member 804 in a sliding engagement with the rail member 802, the guide member 804 can slide to a desired location along the rail member 802. Accordingly, the rail member 802 defines a first reference surface 801*a*. Once located, the guide member 804 can be locked into its desired location by a fastener 808*a*, such as for example a locking or set screw 808*a*.

The guide member 804 preferably defines an elongated guide slot 805*b* for translation of the gauge member 806 in a direction orthogonal to the rail member 803, preferably orthogonal to the unfinished wall and more particularly orthogonal to the wall surface to be mounted to the studs STD1, STD2. The preferred elongated guide slot 805*b* preferably defines an axis of translation E-E in the direction of elongation that is orthogonal to the axis of elongation D-D of the rail member 802. The gauge member 806 is translated and located along or adjacent the guide slot 805*b* based on the wall thickness of the wall to be disposed about the sprinkler in order to define the depth at which the sprinkler body is to be located in the opening or through hole of the wall so as to locate the sprinkler components in their proper operative positions. Accordingly, the guide member 804 and guide slot 805*b* define a second reference surface(s) 801*b* which is preferably graduated to identify the wall thickness of the wall to be disposed about the sprinkler and the optional locations of the guide member 804 along the guide slot 805*b*. For example, the guide member 804 can be graduated in inches N of wall thickness.

The gauge member 806 preferably includes a first gauge portion 806*a* for a preferred sliding engagement with the second reference surface 801*b*, and an opposite second gauge portion 806*b* to define a sprinkler contact surface and more preferably define a stop surface 810 as previously described. The first gauge portion 806*a* preferably defines a bearing surface having a geometry that allows the gauge member 806 to slide adjacent and/or along the second reference surface 801*b* and adjacent the guide slot 805*b* in the direction of the axis E-E. In one particular embodiment, the first gauge portion 806*a* includes a substantially L-shaped surface to bear against the second reference surface 801*b*. To stabilize or assist guidance of the gauge member 806, the guide member 804 can includes a third reference surface(s) 801*c* appropriately spaced from the second reference surface 801*b* to accommodate the first gauge member 806 therebetween. The spaced apart second and third reference surface(s) 801*b*, 801*c* can define a second guide channel extending orthogonal to the first channel of the guide member 804. The third reference surface(s) 801*c* can be correspondingly graduated to indicate the wall thickness; and the gauge member 806 can be appropriately configured to allow for the sliding engagement between the guide and gauge members 804, 806.

To affix or lock the location of the gauge member 806 in the desired position along the guide slot 805*b*, the gauge member 806 includes a locking assembly that preferably increases the frictional engagement between the mated bearing surfaces of the guide and gauge members 804, 806. In one preferred embodiment, the guide and gauge members 804, 806 are joined together by a quick-cam handle assembly 820. The preferred handle assembly 820 includes a threaded shank 822 that extends, as seen in FIG. 5D, through the guide slot 805*b* of the guide member 804 and through a bore 807 formed in the first gauge portion 806*a* of the gauge member 806. The threaded shank 822 preferably engages a complementarily threaded insert 824 disposed in the through bore 807. The quick-cam handle assembly 820 operates to clamp and compress the guide and gauge members 804, 806 therebetween so as to prevent any relative translation between the guide and gauge members 804, 806 along the axis E-E. Known quick-cam handles are available from McMaster-Carr® at http://www.mcmaster.com/#5720k11/=vmbnf2, Part No. 5720K11. The handle 822*a* can be rotated from a position substantially axially aligned with the threaded shank 822 to a position substantially orthogonal to the threaded shank 822 to draw the insert 824 and handle 822*a* toward one another by a cam action to clamp and increase the compressive force between the guide and gauge members 804, 806. Unclamping of the quick-cam handle assembly 820 allows the gauge member 806 to slide relative to the guide member 804 along the guide slot 805*b* to a desired position. Although the clamping is preferably provided by a cam action, alternate embodiments are possible, for example, in which a rotatable knob is used to draw the threaded shank and insert 822, 824 together like a vice.

The second gauge portion 806*b* of the gauge member is preferably configured with a stop surface as previously described for contacting and locating a sprinkler frame. Accordingly, a preferred stop surface 810 is preferably arcuate, defining a central axis of curvature that preferably extends parallel to the slot axis E-E. The curvature of the stop surface 810 provides for a contour stop surface to contact a portion of the sprinkler body 12, such as for example, an edge of the preferred annular wall 30. Alternative geometries of the stop surface 810 can be provided to locate the sprinkler and its components in their appropriate operative positions. With the gauge member 806 properly located along the guide slot 805*b* of the guide member 804, the stop surface 810 locates a sprinkler to be coupled to an adjacent pipe fitting 40 and preferred adapter 50. Moreover, the stop surface 810 locates the components of the sprinkler in their operative position when a cladding, such as for example a dry wall sheet, is disposed over the sprinkler.

In a preferred method of installing a sprinkler in an unfinished wall, the gauge member 806 is adjusted to a referenced height along the guide slot 805*b* of the guide member 804 to the thickness of the dry wall other material that will be used on the wall/ceiling about the sprinkler. With a sprinkler engaged with an adapter 50 and pipe fitting 40, the rail member 802 is placed in contact and more preferably abutting at least two stud members STD1, STD2 and the guide member 804 is laterally located or referenced between the stud members STD1, STD2 and adjacent to the sprinkler, pipe fitting 40, and adapter 50. Again, in one preferred aspect of the installation, the pipe fitting 40 and its inlet face are preferably located relative to the surfaces of the stud members STD1, STD2 contacted by the rail member 602 to facilitate the location of the sprinkler using the installation tool 800 as described herein. The sprinkler is then turned until the sprinkler frame is threaded and/or properly oriented into contact with the stop surface 810 as previously described.

Figure 6B:
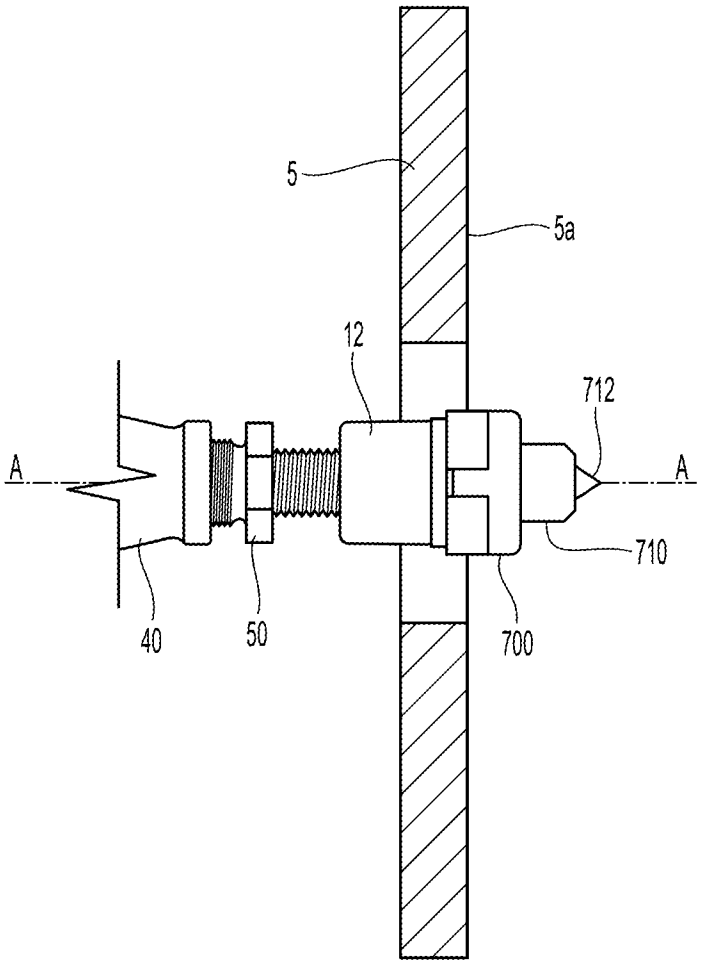
FIG. 6A-6B is a schematic view of installing a finished wall over a sprinkler installed that was installed in unfinished wall using the installation tool of FIG. 5A.
Figure 6A:
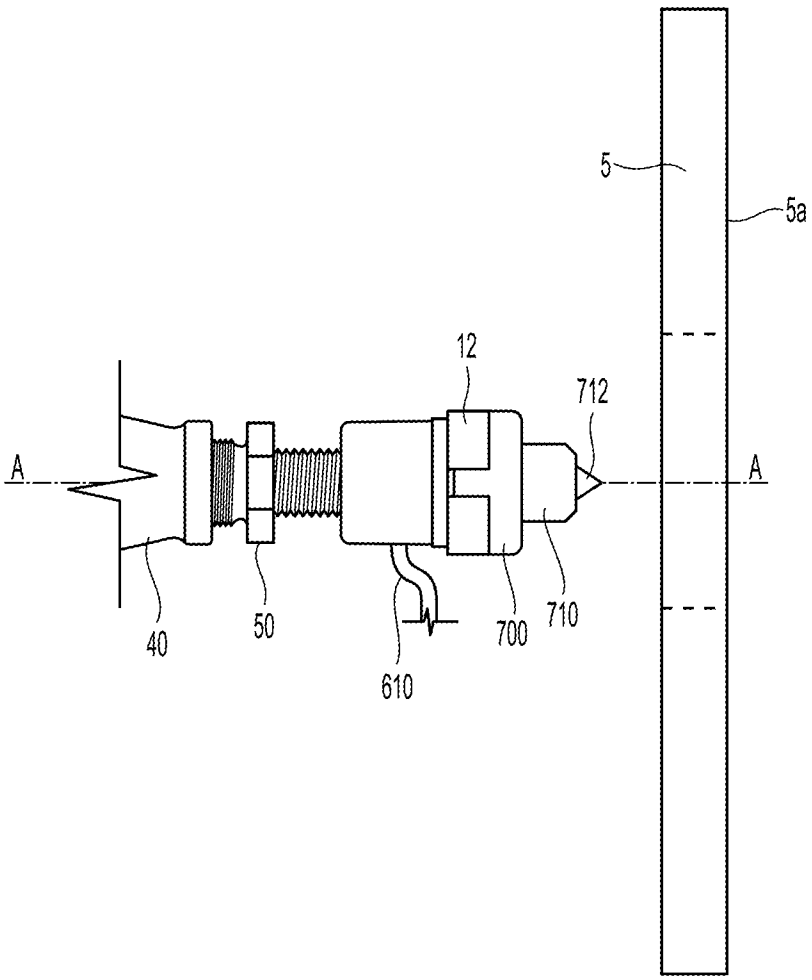

Preferred methods are provided for finishing the unfinished wall installation by locating and forming an opening or through hole in a wall to be mounted over the sprinkler. Shown in FIGS. 6A and 6B is a sprinkler installed and preferably located by the installation tool 600, 800 in an unfinished arrangement as previously described. Preferably disposed over the thermally responsive trigger of the sprinkler is a protective cap 700 that can protect the sprinkler during storage, shipment and handling or during the fire protection system construction and installation. The cap 700 can also engage the sprinkler frame in a manner shown to turn or torque the sprinkler frame into contact with the stop surface 610, 810 in a manner as previously described. The cap 700 can be configured to engage the sprinkler so that the cap can appropriately orient the sprinkler and its internal components visually or mechanically for operation, e.g., a sidewall deflector. The protective cap 700 preferably includes an indicator for indicating the central axis of the sprinkler about which a wall can be circumscribed. In one preferred embodiment of the protective cap 700, the cap includes a handle 710 for installing and/or turning the cap 700. The handle preferably includes the indicator 712 which aligns axially with central axis A-A of the sprinkler. The indicator 712 preferably defines a geometry and/or provides a material that can leave an indicating mark upon contact with a surface, such as for example, the back of a sheet of dry wall or other cladding. In a preferred embodiment, the indicator 712 can defines a substantially triangular geometry with an apex or point aligned along the central axis A-A made of a material of sufficient hardness to mark the back of wall to be mounted about the sprinkler frame 12. The indicator 712 can define an alternative geometry or be of another material to leave a mark in a manner as described herein. For example, the indicator 712 can include an absorbent tip holding a visible dye in liquid or powder form.

In a preferred use of the cap 700, shown in FIG. 6A, the cap 700 is disposed on the installed sprinkler and a wall 5, such as for example a dry wall, is brought proximate to its mounting position and sufficiently into contact with the indicator 712 to leave a mark on the back of the wall 5. The mark left on the back on the wall 5 acts as a centering mark, which a contractor can use to form an opening or through hole in the wall 5. With the through hole formed, as shown in FIG. 6B, the wall 5 is disposed over the sprinkler frame 12 and mounted to the studs (not shown) of the unfinished wall. The wall is of a thickness matching the indicated thickness on the installation tool 600, 800 used during the sprinkler installation process. Accordingly, the components of the sprinkler are located in their operational positions relative to the mounting surface 5*a*.

While the present invention has been disclosed with reference to certain embodiments, numerous modifications, alterations, and changes to the described embodiments are possible without departing from the sphere and scope of the present invention, as defined in the appended claims. Accordingly, it is not intended that the present invention be limited to the described embodiments, but that it has the full scope defined by the language of the following claims, and equivalents thereof.

What is claimed is:

1. An installation tool for installing a sprinkler having a sprinkler frame supporting and housing at least one operational component, the tool comprising:

a gauge defining a stop surface to be contacted by the sprinkler frame;

a rail member defining a first reference surface for locating the stop surface to define an operational position for the sprinkler frame and the at least one operational component within a through hole of a wall; and a guide member defining:

a first channel, wherein the rail member is disposed within the first channel for sliding engagement relative to the guide member; and a second channel extending orthogonally to the first channel, wherein the gauge is disposed in the second channel for sliding engagement relative to the guide member orthogonally to the rail member.

2. The installation tool of claim 1, wherein the tool is for an unfinished installation, and wherein the rail member is an elongated member for engaging at least two parallel stud members to define the first reference surface for laterally locating the stop surface of the gauge, and the guide member includes an elongated guide slot to define a second reference surface for locating the stop surface relative to the wall to be mounted.

3. The installation tool of claim 2, wherein the rail member defines a pair of lateral guide rails, the guide member defining the first channel for sliding engagement along the lateral guide rails and relative to the rail member.

4. The installation tool of claim 3, wherein the gauge includes a first gauge portion for the sliding engagement with the second reference surface of the guide member and a second gauge portion including the stop surface, the first gauge portion defining a bearing surface to slide adjacent the second reference surface.

5. The installation tool of claim 4, further comprising a quick-cam handle assembly and wherein the first gauge portion includes a bore formed therein, the quick-cam handle assembly including a threaded shank extending through the guide slot of the guide member and the bore of the gauge to locate and affix the gauge along the guide slot.

6. The installation tool of claim 4, wherein the stop surface is arcuate and defines a central axis of curvature extending parallel to the axis of translation.

7. The installation tool of claim 4, wherein the second reference surface is graduated corresponding to a plurality of wall thicknesses for the wall to be mounted wherein further the gauge can be located along the guide slot at one of the plurality of wall thicknesses to locate the stop surface relative to the wall to be mounted such that the at least one operational component of the sprinkler is located in its operative position relative to the wall to be mounted.

8. The installation tool of claim 1, wherein the tool is for an unfinished installation, and wherein the rail member is an elongated member for engaging at least two parallel stud members to define the first reference surface for laterally locating the stop surface of the gauge.

9. The installation tool of claim 8, wherein the guide member defines a second reference surface for locating the stop surface relative to the wall to be mounted.

10. The installation tool of claim 8, wherein the rail member includes a first web member and a second web member disposed relative to the first web member to define a pair of lateral guide rails, and the guide member defines a c-channel disposed about one of the first and second web members such that the guide member engages the pair of lateral guide rails.

11. The installation tool of claim 1, wherein the gauge includes a first gauge portion for engaging the second channel and a second gauge portion including the stop surface, and wherein the first gauge portion is continuous with the second gauge portion, the second gauge portion being disposed in a plane parallel to and spaced from the first gauge portion.

12. The installation tool of claim 11, wherein the stop surface is arcuate and defines a central axis of curvature extending parallel to the second channel.

13. The installation tool of claim 1, wherein the tool is for an unfinished installation, and wherein the second channel is graduated corresponding to a plurality of wall thicknesses for the wall to be mounted, wherein further the gauge can be located within the second channel at one of the plurality of wall thicknesses to locate the stop surface relative to the wall to be mounted such that the at least one operational component of the sprinkler is located in its operative position relative to the wall to be mounted.

14. An installation tool for installing a sprinkler having a sprinkler frame supporting and housing at least one operational component, the tool comprising:

a gauge defining a stop surface to be contacted by the sprinkler frame; and a first reference surface for laterally locating the stop surface to define an operational position for the sprinkler frame and the at least one operational component within a through hole of a wall, wherein the tool is for an unfinished installation and the tool includes a rail member defining the first reference surface and a guide member having a sliding engagement with the rail member, the gauge being engaged with the guide member;

wherein the rail member is an elongated member for engaging at least two parallel stud members to define the first reference surface and the guide member includes an elongated guide slot to define a second reference surface for locating the stop surface relative to the wall; and wherein the rail member defines a pair of lateral guide rails, the guide member defining a channel for sliding engagement along the lateral guide rails and relative to the rail member, the guide slot defining an axis of translation orthogonal to the rail member, the gauge having a sliding engagement along the axis of translation relative to the guide member.

15. The installation tool of claim 14, wherein the gauge includes a first gauge portion for the sliding engagement with the second reference surface of the guide member and a second gauge portion including the stop surface, the first gauge portion defining a bearing surface to slide adjacent the second reference surface.

16. The installation tool of claim 15, wherein the channel defines a first channel of the guide member, and the guide member includes a third reference surface spaced from the second reference surface to define a second channel extending orthogonally to the first channel, the second channel accommodating the gauge.

17. The installation tool of claim 15, further comprising a quick-cam handle assembly and wherein the first gauge portion includes a bore formed therein, the quick-cam handle assembly including a threaded shank extending through the guide slot of the guide member and the bore of the gauge to locate and affix the gauge along the guide slot.

18. The installation tool of claim 15, wherein the stop surface is arcuate and defines a central axis of curvature extending parallel to the axis of translation.

19. The installation tool of claim 15, wherein the second reference surface is graduated corresponding to a plurality of wall thicknesses for the wall to be mounted wherein further the gauge can be located along the elongated guide slot at one of the plurality of wall thicknesses to locate the stop surface relative to the wall to be mounted such that the at least one operational component of the sprinkler is located in its operative position relative to the wall to be mounted.

* * * * *